United States Patent [19]

Vellins et al.

[11] 4,072,462

[45] Feb. 7, 1978

[54] TRANSFER PRINTING

[75] Inventors: Cyril Eric Vellins; Leonard Fox Dixon, both of Huddersfield, England

[73] Assignee: L. B. Holliday & Company Limited, Huddersfield, England

[21] Appl. No.: 522,115

[22] Filed: Nov. 8, 1974

[30] Foreign Application Priority Data

Nov. 12, 1973 United Kingdom ..... 52493/73

[51] Int. Cl.[2] ..... D06P 5/06; D06P 5/08; D06P 5/10

[52] U.S. Cl. ..... 8/2.5 A; 8/2.5 R; 106/22

[58] Field of Search ..... 8/2.5 R, 2.5 A, 176

[56] References Cited

U.S. PATENT DOCUMENTS

| | | | |
|---|---|---|---|
| 3,232,692 | 2/1966 | Wilhelm et al. | 8/18 |
| 3,708,261 | 1/1973 | Kasper et al. | 8/116.3 |
| 3,768,280 | 10/1973 | Kannegiesser et al. | 68/5 D |
| 3,782,896 | 1/1974 | Defago et al. | 8/2.5 |

FOREIGN PATENT DOCUMENTS

| | | | |
|---|---|---|---|
| 639,192 | 4/1962 | Canada | 8/2.5 UX |
| 1,591,909 | 6/1970 | France | 8/2.5 UX |
| 2,045,465 | 6/1971 | Germany | 8/2.5 UX |
| 1,957,262 | 9/1970 | Germany | 8/2.5 A UX |
| 460,695 | 4/1968 | Switzerland | 8/2.5 A |

OTHER PUBLICATIONS

American Dyestuff Reporter, Salvin, U. S., (6-5-67), pp. 31-35.

*Primary Examiner*—Stanford M. Levin
*Attorney, Agent, or Firm*—William R. Liberman

[57] ABSTRACT

The invention relates to the fixing of disperse dyestuffs which are printed by transfer from support webs onto fabric webs. Fabrics which are cellulosic or part cellulosic are treated with suitable resins which are uncured or part cured and are chosen to have hydroxymethyl, alkoxymethyl and/or aldehyde groups capable of reacting with corresponding reactive amino, hydroxy and/or hydroxyalkylamino groups of the dye or dyes used in the printing inks. The heat treatment for transfer of the print from the support to the textile fabric is effected under such conditions of temperature and time that either curing or end curing of the resins takes place with simultaneous fixing of the dyes onto the textile fabric through reaction between the reactive groups of the dyes and corresponding unreacted end groups of the resins.

16 Claims, No Drawings

TRANSFER PRINTING

This invention relates to the transfer printing of fibres or fabrics comprising either natural or synthetic cellulosic material or mixtures thereof such as cotton and/or viscose rayon fibres or fabrics, or various blends of natural and/or synthetic cellulosic materials in fibre or fabric form with one or more non-cellulosic natural and/or synthetic materials.

Transfer printing has been employed successfully with synthetic fibres or fabrics such as polyester, polyamide, acrylic, triacetate and diacetate materials, but has failed with cellulosic materials and does not give commercially viable results with blends of cellulosic materials and polyester, polyamide, acrylic or di- or tri-acetate materials. Since, in commercially available 80/20, 67/33 and 50/50 polyester/cellulosic blends, for instance, the cellulosic portion is significant and increases from 20–50%, transfer printing with such blends gives weak prints which take on a faded look. Furthermore, a single I.S.O. 3 wash causes changes in shade which are not commercially acceptable. The reason for this effect is that the dyestuff which has been applied to the polyester/cellulosic blend has no affinity for the cellulosic portion of the blend and consequently will always wash off and produce a marked reduction in the shade of the blended material. In the extreme case in which there is no polyester or other synthetic material present, i.e. with 100% cellulosic material, transfer printing is unacceptable both from the viewpoint of extremely poor wash fastness and also because of the lack of affinity in the case of the weak shades.

The lack of affinity of disperse dyes for cellulosic materials can be readily demonstrated by placing a piece of polyester fabric under a piece of 100% cellulosic fabric, and subjecting the two materials to transfer printing at 200° C for 20 seconds with an appropriate disperse dyestuff. The result shows that the print has passed right through the cellulosic material causing a slight coloration but that the polyester material underneath is strongly printed. In other words, the dyestuff vapours have passed through the cellulosic material which has substantially no affinity for the disperse dyestuff and have coloured the polyester material which has considerable affinity for the dyestuff.

According to our invention, we provide a method of transfer printing in which printing is effected by transfer from a web of support material printed with an ink formulation containing at least one sublimable dyestuff suitable for transfer printing and having one or more amino, hydroxy or hydroxyalkylamino groups in the dyestuff molecule, or any combination thereof, onto a textile fabric composed of a natural and/or synthetic cellulosic material alone or in a blend with at least one natural and/or synthetic non-cellulosic material, the textile fabric having thereon a curable resin, which is either uncured or partly cured and contains one or more hydroxymethyl, alkoxymethyl or aldehyde groups capable of reaction with the amino, hydroxy or hydroxyalkylamino groups of the dyestuff or dyestuffs, the transfer printing being effected at a sufficiently high temperature and for a sufficient period of time to effect both a transfer of the sublimable dyestuff to the textile fabric and either a curing or an end-curing of the resin with simultaneous fixing of the dyestuff onto the cellulosic or part cellulosic textile fabric.

As indicated above, the improved method of transfer printing may relate to materials wholly composed of natural or synthetic cellulosic fibre, for example, cotton or rayon or mixed cotton-rayon fabrics. Alternatively, the method may be used with various polyester-cotton blends, for example 80/20, 67/33 and 50/50 polyester-cotton blend. Similarly, the process may be used with polyester-rayon blends and polyamide-cellulosic blends for example with different proportions of the components. The process is also applicable to blends of three or more different components one of which is cellulosic in nature, whether natural or synthetic.

It is possible to apply the process to a textile material which has been first treated with a resin known to be compatible with the intended dye or dyes and which has been partly cured. The process then involves further or end curing which leads to the desired reaction, e.g. of cross-linking, with the dyestuff, and a resulting fixing of the dye or dyes on the textile fibre or fabric. On the other hand, we prefer that the fabric should simply be impregnated with a resin and catalyst mixture and that the transfer printing process should be carried out under such conditions that both curing of the resin or resins and their desired reaction with the dye or dyes should take place as a result of the heat treatment used to transfer the dyes to the fabric.

Accordingly, in a preferred embodiment of the invention, after impregnation of the fabric by means of an aqueous solution or suspension of the resin or resins which have been chosen, only removal of excess liquid and sufficient drying for the fabric to be subjected to the transfer printing process is then effected and the use of high temperatures which would cause partial or complete curing of the resins is avoided. Nevertheless, it should be emphasised that the process is applicable to the case of part curing of the resin provided that at least some of the curing can take place whilst the dyes are being transferred from the support web, e.g. the paper web, to the textile fabric web.

It will be appreciated that there are a very large number of possible dyestuffs which are applicable to this process and a large number of corresponding resins. Furthermore, the precise temperatures and catalysts used for curing and the subsequent reaction with the dyestuffs may be varied according to the nature of the resins and dyestuffs employed. In general, however, temperatures in the range of from 180° - 240° C. are used and the transfer printing process takes place over a period of time extending from 5 seconds to 1½ minutes when both curing and transfer printing are carried out in one operation. If partial curing is carried out in a first stage then this may be effected, for example, at 140° C for 3 - 4 minutes or at 180° C for ¾- 1 minute, the transfer printing and end curing may be carried out at 180° - 240° C for a period of time of time 5 - 60 seconds.

If so desired, the transfer printing can be carried out under vacuum conditions which may improve the results obtained.

A large number of commercial resins are available which can undergo condensation or cross-linking when heated in the presence of the appropriate catalysts and under the right conditions of time and temperature. A number of these resins are sold under trade names and it is therefore not always possible to know their precise constitution. The so called "amino resins" may be used.

One class comprises the urea-formaldehyde precondensates. Another comprises resin precondensates made by the reaction with formaldehyde of melamine, ethyleneurea, dihydroxyethyleneurea and other like amino derivatives. Free formaldehyde which is further reacted in the combined curing and fixing supplies the free aldehyde groups of the uncured or partly cured resin and the precondensates contain e.g. hydroxymethyl or methoxymethyl group. The urea-formaldehyde precondensates result from the solution of urea in formalin and dilution to the required bath concentration. The product contains mainly monomethylol-urea and dimethylol urea in proportions depending on the ratio of urea to formaldehyde employed. Condensation has to be carefully controlled so that it does not go too far.

Dimethylolurea may be isolated and dried or converted to paste form but accelerators are needed to give the final condensation, and these may lead to a gradual development of acidity in the resin solution. Resin precondensates may also be modified by additives such as hexamine which prevent the crystallisation of methylol-ureas and retard the development of acidity. Alternatively, the methylol-ureas may be stabilised by methylation. The resulting crystalline products are highly resistant to further condensation but will still condense normally when applied to the fabric in conjunction with an accelerator and subjected to the heat transfer treatment needed to effect the curing of the resin and the fixing of the dye onto the fabric. These methylated products are of particular value for the present purpose.

The reaction of melamine with formaldehyde leads first to the production of methylol-melamines and up to 6 molecules of formaldehyde can be combined with 1 molecule of melamine. Solutions of methylol-melamines are however very reactive and insoluble products are formed quite rapidly so that stabilisation by methylation is again normally required. Methylated trimethylol-melamine is a preferred resin but we may use products based on tetra- or pentamethylol-melamine. We may also use partially esterified or etherified products provided the resin has at least one free methylol group in the molecule.

Whereas the urea-formaldehyde precondensates are particularly useful with cottons, rayons and mixtures of cotton and rayon, the melamine-formaldehyde resins are of special value in mixtures of acrylic fibres with cotton and/or rayon fibres.

As an alternative to the urea-formaldehyde or malamine-formaldehyde resins, we may use the products of the reaction between formaldehyde and cyclic ureas which do not contain any free imino (—NH—) groups, and are therefore not readily affected by chlorine treatment. The majority of cyclic urea resins or cyclic reactants are based on ethyleneurea, dihydroxyethyleneurea, uron and triazones.

Alternatively, we may use derivatives of hexamethylol melamine which are also free from imino (—NH—) groups.

We indicate below one example of a product of this kind:

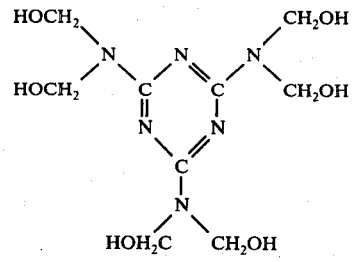

In order to obtain good results, all stages of the resin impregnation and of the subsequent resin curing and dye must be carefully controlled, i.e. the preparation of the textile fabric before impregnation with the resin precondensate solution, the preparation of the padding bath including the addition of a suitable quantity of accelerator and/or catalyst, and the final curing process. Cotton and rayon fabrics and part-cellulosic fabrics must be desized and scoured before treatment for proper penetration of the resin precondensate into the fibre. In the case of cotton, better results are obtained if the fabric is also mercerised. The curing process involves of course the development of sufficient acidity in the fabric to ensure full condensation of the resin. The resin bath must therefore contain sufficient accelerator to ensure this state provided the fabric is either neutral or just acid when first immersed in the resin solution. Accordingly, if the fabric has been mercerised or otherwise made alkaline, the alkalinity must be removed before the resin treatment, e.g. by means of dilute acetic acid.

An accelerator or catalyst is needed to ensure an adequate cure in the subsequent baking stage. Free acids are not generally used as they adversely affect the stability of the bath, and substances which only develop acidity at a later stage are employed in preference.

According to the particular resins employed the catalysts may be, for instance, zinc nitrate, magnesium chloride, ammonium chloride, ammonium thiocyanate ammonium dihydrogen phosphate, ammonium nitrate, ammonium sulphate; diammonium phosphate or ammonium oxalate. These are only examples of some of the more common conventional catalysts and naturally other catalysts which are commonly employed in the curing of resins conventionally employed for the finishing of textile fabrics may be used where appropriate.

Ammonium salts such as ammonium dihydrogen phosphate or ammonium thiocyanate give good results but suitable metal salts such as magnesium chloride or zinc nitrate and special quaternary ammonium salts, e.g. Catalyst AC (Monsanto), are also affective. Magnesium chloride is preferred for use with melamine resins, but zinc nitrate is more efficient with urea and cylic urea based products.

The bath may also contain other additives such as wetting agents to assist in fabric penetration, softeners such as stearamide-modified resins or polyethylene emulsions, stiffeners such as polyvinyl alcohol, starch, cellulose ethers or more highly condensed urea-formaldehyde resins and handle modifiers which are frequently acrylic latices. Care must be taken that the materials employed are compatible with one another and in particular that cationic and anionic dispersions are not mixed which would lead to precipitation.

The actual quantities of commercial resins and catalysts which may be used depend upon the strength at which the resin or resin mixture is sold but this can be readily determined by trial and error. Thus a stiff finish or a brownish coloration after the heat treatment to cure the resins and to fix the dyes onto the fabric indicates that too large an amount of resin has been used. Conversely, the use of too small an amount will not achieve the desired fixing of the dyestuff onto the cellulosic or part cellulosic fabric quite apart from the question of an insufficient finish.

The quantity of resin to be applied to the fabric is decided upon and the bath concentration is then adjusted to allow the pick-up or expression of the mangle employed. The expression depends upon the nature of the fabric and it is preferable to determine the pick-up for the fabric to be treated by direct experiment. The fabric is impregnated with the previously prepared resin solution and mangled to remove excess liquor. In this way, a predetermined concentration of resin is applied evenly throughout the fabric and as much excess liquor as possible is removed so as to improve the subsequent drying operation. In general, a pick-up of 50 - 70% is satisfactory for cotton fabrics and 65 - 85% for viscose rayon fabrics. Similar values are determined by experiment for mixtures of cotton and/or rayon fibres with non-cellulosic fibres such as polyamides, polyesters and acrylics. Too high a pick-up is undesirable since it increases the cost of the subsequent drying process and can lead to resin migration to the hot surface of the fabric.

A three bowl mangle threaded to two dips and two nips is satisfactory for most fabrics, the squeeze between the two dips greatly assisting penetration. Even under the best conditions, however, diffusion of the resin within the fabric may still be incomplete on leaving the mangle and better results can often be obtained by "skying" i.e. passing over rollers so as to expose the fabric to ambient air or by using a "scray" i.e. a flat mobile platform on which the fabric is laid in zig-zag or concertina fashion and kept for a period again so as to expose it to ambient air, and before drying.

The fabric should be dried in such a way as to reduce migration of resin to a minimum. Migration always occurs towards the surface on which water is being evaporated and is exaggerated if heating is confined to one surface of the fabric. A pin tenter provided with two-sided hot air drying and running at over 20 yards per minute is preferred. If drying cylinders are used, they should be run as fast as possible (over 30 yards per minute at least) and warp tension should be reduced to a minimum. In all methods of drying, low running speeds are considered inadvisable since they are much more likely to lead to resin migration. Little migration takes place one the moisture content of the fabric has been reduced below 40% and high temperatures particularly in the early stages of drying are therefore to be preferred.

The fabric should have a moisture content not exceeding 10% as it leaves the drier and overdrying is preferable to underdrying.

When the fabric has been satisfactorily dried, it is necessary to condense or to polymerise the resin in the fibres to develop the required properties. This is usually done by subjecting the fabric to a dry heat treatment for a relatively long time at a low temperature (just over 100° C) or for a shorter time at a higher temperature. In practice, temperatures below 140° C are likely to involve times which are too long for efficient working and temperatures above 180° C are likely to lead to variable results. The actual time required depends on the efficiency of heat-exchange in the curing equipment and the nature of the fabric but the baking times given above and which are summarised in the table below for different temperatures are usually close to the optimum for equipment in which heat is provided by hot air circulation:

Baking Times at Various Temperatures

140° C : 3 - 4 minutes
150° C : 2½ - 4 minutes
160° C : 1½ - 2½ minutes
170° C : 1 - 1½ minutes
180° C : ¾ - 1 minute A baking unit provided with driven rollers at the top and bottom will minimise tension at this stage and is most commonly used but stenters and other hot air drying equipment can also be employed.

Cloth with a high moisture content on leaving the drier will obviously take longer to reach baking temperature and some compensation should be allowed for this factor.

The so-called washing off normally employed in resin finishing processes is omitted.

The following are examples given by way of illustration only of specific compounds contained in resin precondensates which may be used in the combined resin casing and dye fixing method of the invention.

Dimethylol Urea:

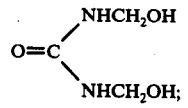

Dimethoxymethyl Urea:

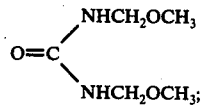

Methoxymethyl melamine:

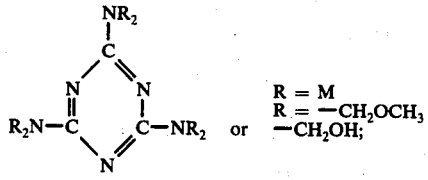

e.g. varying from trimethoxymethyl melamine to hexamethoxymethyl melamine;

Dimethylol alkane diol diurethane $HOCH_2-NH-CO-O-(CH_2)_n-O-CO-NH-CH_2OH$
where n = 2 to 10;

Dimethylol ethylene urea:

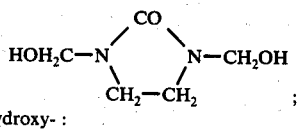

Dimethylol dihydroxy- : ethylene urea

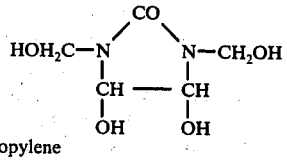

Dimethylol propylene urea:

-continued

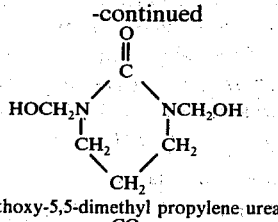

Dimethylol 4-methoxy-5,5-dimethyl propylene urea :

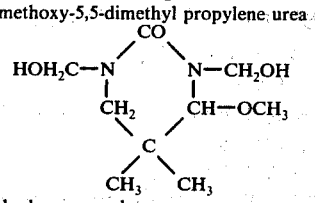

Dimethylol -5-hydroxypropylene urea :

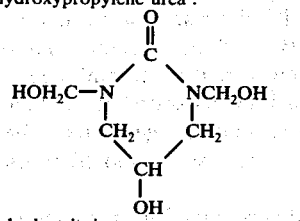

Dimethylol hexahydrotriazinones :

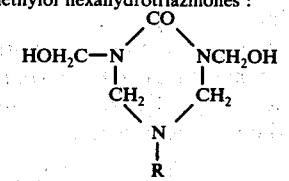

R = alkyl or alkylol

Dimethyloxymethyl urone :

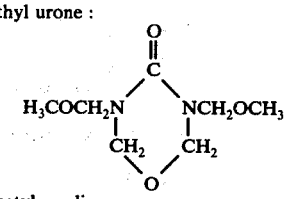

Tetramethylol acetylene diurea :

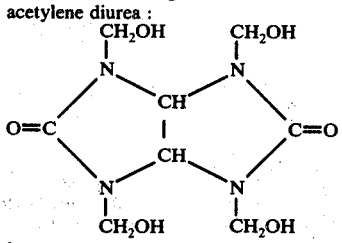

Dimethylol carbamates

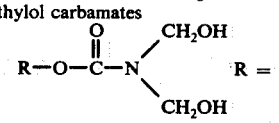

R = alkyl, hydroxyalkyl or alkoxyalkyl

E.G. :
Methylolacrylamide:

$$CH_2{=}CH{-}CO{-}NHCH_2OH$$

In general, the dyestuffs with which the process is concerned are those which are capable of being transfer printed by sublimation, i.e. transferred from a support web such as a paper web to a textile fabric web through the application of heat.

The great majority of such dyestuffs fall in the class known as disperse dyestuffs and these include amongst others anthraquinone and azo dyestuffs. In order that these disperse dyestuffs may be applicable to the process of the invention, they must have the further characteristic that they should be capable of reacting with the hydroxymethyl, alkoxymethyl (e.g. methoxymethyl) or aldehyde groups of the resin molecules. Thus, the dyestuff molecules must carry one or more amino, hydroxy or hydroxyalkylamino groups in the molecule so as to achieve the desired fixing under the effect of heat.

The anthraquinone dyes may for example be substituted by amino groups in the 1 and 4 positions or may have a 1-amino group and a 4-hydroxy, 4-methylamino 4-ethylamino or 4-anilino group. The molecule may also carry other substituents, e.g. a cyano or methoxy group in the 2 or 3 position.

The azobenzenes may have for example opposed nitro and amino groups in the 4,4′ positions and may carry other substituents such as hydroxy or methoxy.

The following are examples of specific dyestuffs containing groups capable of reacting with the corresponding hydroxymethyl, alkoxymethyl or aldehyde groups of the resins used in association therewith:

1,4-diamino-anthraquinone;
1,4-diamino-2-methoxyanthraquinone;
4′-nitro-4-amino-azobenzene;
2′-chloro-4′-nitro-4-(N-hydroxyethyl-N-ethylamine)-azobenzene;
4′-hydroxy-(phenylazo)-azobenzene;
1-amino-2-cyano-4-anilinoanthraquinone;
1-amino-2-cyano-4-methylaminoanthraquinone;
1-amino-3-cyano-4-ethylaminoanthraquinone;
1-amino-4-hydroxy-anthraquinone;
1-amino-4-hydroxy-2-methoxyanthraquinone;
4′-nitro-2,5-dimethyl-4-amino-azobenzene;
4′-acetylamine-2-hydroxy-4-methylazobenzene;
1-amino-4-anilinoanthraquinone;
1-amino-4-(4′-aminophenylamino)-anthraquinone;
1-hydroxy-4-(3′-aminophenylamino)-anthraquinone;
1-amino-2-chloro-4-hydroxyanthraquinone; and 1,5-diamino-4,8-dihydroxy-anthraquinone.

Mixtures of two or more dyestuffs may be used in various combinations to give different shades.

One embodiment of the process is now described.

An appropriate textile fabric composed for example of a 50/50 polyester cotton blend is used. This is impregnated with an aqueous solution containing an appropriate resin, for example dimethylol dihydroxy ethylene urea and an appropriate catalyst, for example, zinc nitrate. The 50/50 polyester cotton blend is impregnated with this aqueous solution so as to give an even distribution of a predetermined concentration of resin and catalyst mixture throughout the material. After impregnation, excess resin mixture and catalyst is removed by passing the material through a mangle which is set to give a pick up of 50 – 85% according to the particular requirements. The material is now dried in the normal way by using a pin tenter provided with two-sided hot air drying, or by means of drying cylinders. In either case, a fast running speed is needed to prevent resin migration. The material can now be transfer printed with simultaneous curing of the resin by heat treatment at a temperature of 180° – 240° C for a period of time of from 5 seconds to 1½ minutes. Alternatively, the material can be cured in the normal way for example, at 140° C for 3 – 4 minutes, at 150° C for 2½ – 3 minutes, at 160° C for 1½ – 2½ minutes, at 179° C for 1 – 1½ minutes or at 180° C for ¾ – 1 minute. The textile fabric with the partly cured resin is then transfer printed at 180° – 240° C for a period of from 5 seconds to 1 minute.

If desired, the transfer printing can be carried out under vacuum conditions.

The invention is illustrated by the following examples.

EXAMPLE 1

A resin solution was made up as follows.

10 lbs. of B.I.P. Resin L 5555 (a proprietory amine/-formaldehyde resin supplied by B.I.P. Chemicals Ltd. Manchester 6.4 ozs. urea 1.28 ozs. ammonium chloride 10 gals. water A polyester-cotton (50/50) fabric was immersed in this mixture, expressed to a 50% wet weight take-up, and then dried rapidly to prevent curing. A piece of fabric so treated was transfer printed at 210° C for 20 secs. With a paper coated with an ink containing 1.4-diaminoanthraquinone. A clear blue-violet print showing an acceptable affinity or build-up and a satisfactory fastness to washing was obtained.

EXAMPLE 2

The same fabric was transfer printed as in example 1 under the same conditions but using instead of the dye of example 1, the following azo dye:

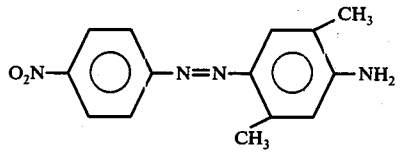

An orange print of satisfactory properties comparable with those of Example 1 was obtained.

EXAMPLE 3

A cotton fabric, umpregnated with 0.4 – 0.8% of magnesium chloride and 2 – 4% (dry weight) of Knittex NCR (a proprietory resin based on dimethylol ethylene urea and melamine) was similarly transfer printed using the dyestuff of example 1, to give a similar satisfactory result.

EXAMPLE 4

The resin-treated cotton of example 3 was transfer printed with the dye 1-amino-4-hydroxy-2-bromoanthraquinone at 210° C for 10 secs. to give a strong bluish red print with satisfactory washness and other properties e.g. good build-up.

EXAMPLE 5

The resin-treated cotton of example 3, was transfer printed as in example 1, but using the dye:

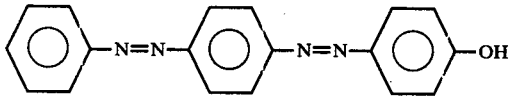

to give a strong yellow print of satisfactory wash fastness, and with an acceptable dye affinity.

EXAMPLE 6

Cotton was treated with FIXAPRET PCLS/magnesium chloride to give a dry uptake weight of 2 – 4%, as in example 3. Fixapret PCLS is a dimethylol-4-methoxy-5,5-dimethyl propylene urea supplied by B.A.S.F. Transfer printings carried out with the dyes used in examples 1, 2, 4 and 5 had a satisfactory wash fastness and acceptable affinity and build-up.

EXAMPLE 7

A 50/50 polyester-cotton was impregnated as in example 6 with Fixapret PCLS, and cured at 190° C for one minute. Unfixed resin was then removed by washing. Transfer printings carried out using the dyes of the previous examples had a good wash fastness; and an acceptable affinity and build-up.

EXAMPLE 8

A 50/50 polyester cotton fabric was impregnated with Beetle resin BT 323, (a proprietory stearamide modified melamine-formaldehyde resin containing 2% zinc nitrate, based on the weight of resin) to give a fabric containing 5% (dry weight) of resin. After curing for 3 minutes at 150° C, the fabric was transfer printed at 210° C for 20 secs. with a paper coated with 1,4-diaminoanthraquinone. A bright blue-violet print with satisfactory wash fastness was obtained. Build-up tests were also satisfactory.

EXAMPLE 9

A resin solution was made up as follows:

100 g Beetle resin BT 322 (a proprietory methylated urea formaldehyde precondensate supplied by BIP)

0.8 g ammonium chloride 4 g urea water to 1 liter

A polyester/cotton 50/50 blend was immersed in the above resin solution, expressed to a 50% wet, weight take-up, and then dried on a pin tenter. The resulting fabric was transfer printed at 220° C for 20 secs using a paper printed in a patterned design with inks comprising 1-amino-4-hydroxy-anthraquinone, 4'-acetylamino-2-hydroxy-4-methylazobenzene and 1-amino-2-cyano-4-anilinoanthraquinone. A coloured material was obtained containing a red, yellow and blue design.

The fabric showed good build-up and a satisfactory wash fastness.

EXAMPLE 10

When the 0.8 g of ammonium chloride in example 9 was replaced with 0.5 ammonium thiocyanate, a similar red yellow and blue pattern was obtained with similar satisfactory build-up and wash fastness properties.

EXAMPLE 11

When the 0.8 g of ammonium chloride in example 9 was replaced with 1 g of zinc nitrate (anhydrous) a similar red, yellow and blue design was obtained with similar satisfactory properties.

EXAMPLE 12

When the Beetle Resin BT 322 resin of example 9 was replaced with Beetle resin 1467 (a methylated melamine-formaldehyde condensate made by B.I.P. similar satisfactory results were obtained.

EXAMPLE 13

When the Beetle resin BT 322 resin of ex. 9 was replaced with Beetle Resin BT 6 ( a partially condensed urea-formaldehyde resin (BIP), similar satisfactory results were obtained.

EXAMPLE 14

When the Beetle resin BT 322 resin of ex. 9 was replaced with BT 324 (a dimethylolethylene urea resin made by BIP, similar satisfactory results were obtained.

EXAMPLE 15

When the BT 322 resin of ex. 9 was replaced by BT 325 (a high condensed urea-formaldehyde resin) similar satisfactory results were obtained.

EXAMPLE 16

When the BT 322 resin of ex. 9 was replaced with BT 326 (a highly condensed modified urea-formaldehyde resin) similar satisfactory results were obtained.

EXAMPLE 17

When the BT 322 resin of ex. 9 was replaced with BT 328 (a cyclic reactant modified methylated melamine formaldehyde condensate) similar satisfactory results were obtained.

EXAMPLE 18

When the BT 322 resin of ex. 9 was replaced with BT 329 (a methylated melamine-formaldehyde precondensate), similar satisfactory results were obtained.

EXAMPLE 19

When the BT 322 resin of ex. 9 was replaced with BT 333 (a cyclic reactant modified methylated melamine formaldehyde condensate), similar satisfactory results were obtained.

EXAMPLE 20

When the BT 322 resin of ex. 9 was replaced with BT 334 (a cyclic reactant modified methylated melamine-formaldehyde precondensate), similar satisfactory results were obtained.

EXAMPLE 21

Baths were made up containing 50 - 120 g/liter of Permafresh LF (a dihydroxy dimethylol ethylene urea, a product of Warwiek Chemicals) for 100% cotton;

150 - 200 g/liter for 67% polyester/33% cotton;

240 - 300 g/liter for 67% polyester/3% rayon;

100 - 120 g/liter for 50% cotton/50% polyester and as catalysts:

zinc nitrate: 20% by weight based on the Permafresh LF resin; and magnesium chloride: 30% by weight based on the resin impregnation and removal of excess resin, fabrics were dried on a pin stenter and cured for 2 - 3 mins at 160° C.

The resultant fabrics were transfer printed with paper containing the dyestuffs given in the following Table I producing the shades indicated in the table.

Table I

| Dyestuff | Shade obtained after printing |
|---|---|
| 1,4-diamino-anthraquinone | Reddish blue |
| 1,4-diamino-2-methoxyanthraquinone | Red-violet |
| 4'-nitro-4-amino-azobenzene | Orange-red |
| 2'-chloro-4'-nitro-4-(N-hydroxyethyl-N-ethyl-amino)-azobenzene | Dark red |
| 4'-hydroxy-4-(phenylazo)-azobenzene | Golden yellow |
| 1-amino-2-cyano-4-aniline-anthraquinone | Bluish green |
| 1-amino-2-cyano-4-methylamino-anthraquinone | Greenish blue |
| 1-amino-3-cyano-4-ethylamino-anthraquinone | Reddish blue |

Table I-continued

| Dyestuff | Shade obtained after printing |
|---|---|
| 1-amino-4-hydroxy-anthraquinone | Bluish red |
| 1-amino-4-hydroxy-2-methoxy-anthraquinone | Red |
| 4'-nitro-2,5-dimethyl-4-amino-azobenzene | Bluish red |
| 4'-acetylamino-2-hydroxy-4-methyl-azobenzene | Yellow |
| 1-amino-4-anilino-anthraquinone | Royal Blue |
| 1-amino-4-(4'-aminophenylamino)-anthraquinone | Blue |
| 1-hydroxy-4-(3'-aminophenylamino)-anthraquinone | Reddish Blue |
| 1-amino-2-chloro-4-hydroxy-anthraquinone | Pink |
| 1,5-diamino-4,8-dihydroxy-anthraquinone | Blue |

All the printings showed a good affinity and build-up and a satisfactory wash fastness.

EXAMPLE 22

As a comparison, both cotton and 50/50 polyester-cotton fabrics were transfer printed with the dyes of the preceding examples, without the use of the resins mentioned. The printings were often smudgy and faint in the case of the 100% cotton fabrics and uneven in the blends. Overall, they showed the distinctly lower affinity and build-up properties. The wash fastness was also inferior in each case when a dyeing comparison was made between the resin treated fabric according to the invention and the untreated fabric.

EXAMPLE 23

Examples 1 - 21 are repeated using a Spooner "VAC-TRAN" vacuum transfer print machine operated at a vacuum of 27 inches of mercury at 180° - 190° C for 20 - 30 seconds. Similar results were obtained.

We claim:

1. A method of transfer printing in which printing is effected by transfer from a paper support web printed with an ink formulation containing at least one sublimable dyestuff suitable for transfer printing and having one or more amino, hydroxy or hydroxyalkylamino first reactant groups in the dyestuff molecule, or any combination thereof, onto a textile fabric composed of a natural and/or synthetic cellulosic material alone or in a blend with at least one natural and/or synthetic non-cellulosic material, the textile fabric having thereon a curable resin which is at least partly uncured and contains one or more hydroxymethyl, alkoxymethyl or aldehyde second reactant groups capable of reaction with the first reactant groups of the dyestuff or dyestuffs, the transfer printing being effected at a sufficiently high temperature and for a sufficient period of time to effect both a sublimation transfer of the sublimable dyestuff to the textile fabric and either a curing or an end-curing of the resin with simultaneous reaction between said first and second reactant groups to fix the dyestuff onto the cellulosic or part cellulosic textile fabric.

2. A method as claimed in claim 1 in which a textile fabric consisting essentially of cotton, rayon or a cotton/rayon mixture is subjected to the transfer printing treatment.

3. A method as claimed in claim 1 in which the textile fabric consists essentially of a blend of natural and/or synthetic cellulosic material with one or more non-cellulosic materials.

4. A method as claimed in claim 3 in which an 80/20, 67/33 or 50/50 polyester-cotton blend is used as the textile fabric.

5. A method as claimed in claim 3 in which a polyester/rayon blend is used as the textile fabric.

6. A method as claimed in claim 3 in which a polyamide cellulosic blend is used as the textile fabric.

7. A method as claimed in claim 1 in which the resin or resins is, or are, urea-formaldehyde, melamine-formaldehyde or methylated malemine formaldehyde precondensates.

8. A method as claimed in claim 6 in which the resin or resins comprise one or more of the following compounds:

Dimethylol Urea :

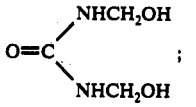

Dimethoxymethyl : Urea

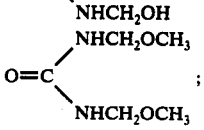

Methoxymethyl : melamine

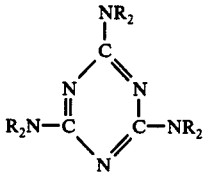

R = H
R = $-CH_2OCH_3$
or $-CH_2OH$ ;

Dimethylol alkane diol diurethane :

$HOCH_2-NH-CO-O-(CH_2)_n-O-CO-NH-CH_2OH$ where n = 2 to 10 ;

Dimethylol : ethyleneurea

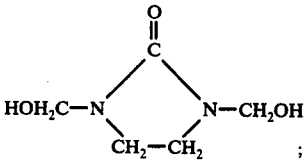

Dimethylol dihydroxy : ethylene urea

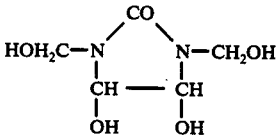

Dimethylol propylene urea :

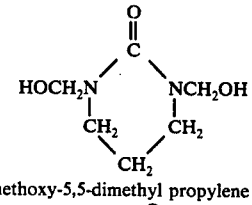

Dimethylol 4-methoxy-5,5-dimethyl propylene urea :

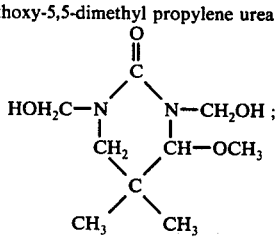

Dimethylol 5-hydroxypropylene urea :

-continued

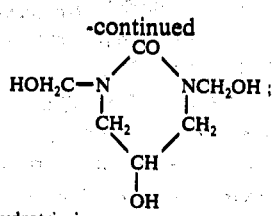

Dimethylol hexahydrotriazinones :

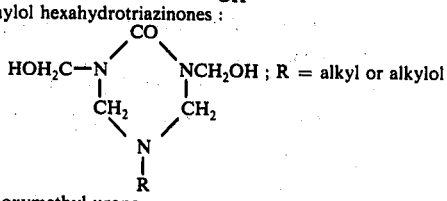

R = alkyl or alkylol

Dimethoxymethyl urone :

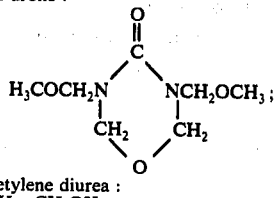

Tetramethylol acetylene diurea :

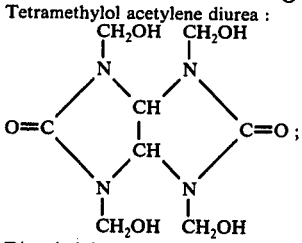

Dimethylol carbamates :

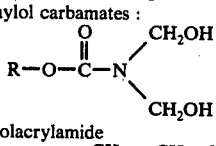

R = alkyl, hydroxyalkyl or alkoxyalkyl

Methylolacrylamide $CH_2 = CH-CO-NHCH_2OH$ .

9. A method as claimed in claim 1, in which the curing of the resin or resin mixture in one or more stages is effected in the presence of a catalyst chosen from zinc nitrate, magnesium chloride, ammonium chloride, ammonium thiocyanate, ammonium dihydrogen phosphate, ammonium nitrate, ammonium sulphate, diammonium phosphate or ammonium oxalate, or any mixture thereof.

10. A method as claimed in claim 1 in which the curing of the resin or resins and the fixing of the dye or dyes onto the resin-treated fabric is effected in one stage at a temperature from 180 - 240° C, for a period of time of from 5 seconds to 1½ minutes in the presence of at least one catalyst and/or accelerator for the resin or resins employed.

11. A method as claimed in claim 1 in which a part curing of the resin or resins is first effected in the presence of at least one catalyst and/or accelerator at a temperature of 140° C for 3 - 4 minutes; 150° C for 2½ - 3 minutes; 160° C for 1½ - 2½ minutes; 170° C for 1 - 1½ minutes; or 180° C for ¾ - 1 minute; and, in a second stage, the fabric carrying the partly cured resin material is subjected to transfer printing with one or more dyes corresponding to the resin or resins employed at a temperature of 180° - 240° C for a period of time of from 5 seconds to 1 minute, whereby curing of the resin material is completed and the dye or dyes, is or are fixed onto the resin-treated fabric.

12. A method as claimed in claim 1 in which the dye or dyes employed is, or are, disperse dyestuffs.

13. A method as claimed in claim 12 in which the disperse dye or dyes are anthraquinone dyestuffs having one or more amino, hydroxy or hydroxyalkylamino groups in the dyestuff molecule.

14. A method as claimed in claim 12 in which the disperse dye or dyes are azo dyestuffs having one or more amino hydroxy or hydroxyalkylamino groups in the dyestuff molecule.

15. A method as claimed in claim 12 in which the dye or dyes employed are chosen from amongst the following:

1,4-diamino-anthraquinone;
1,4-diamino-2-methoxyanthraquinone;
4'-nitro-4-amino-azobenzene;
2'-chloro-4'-nitro-4-(N-hydroxyethyl-N-ethylamino)-azobenzene;
4'-hydroxy-4-(phenylazo)-azobenzene;
1-amino-2-cyano-4-anilinoanthraquinone;
1-amino-2-cyano-4-methylaminoanthraquinone;
1-amino-3-cyano-4-ethylaminoanthraquinone;
1-amino-4-hydroxyanthraquinone;
1-amino-4-hydroxy-2-methoxyanthraquinone;
4'-nitro-2,5-dimethyl-4-aminoazobenzene;
4'-acetylamino-2-hydroxy-4-methylazobenzene;
1-amino-4-anilinoanthraquinone;
1-amino-4-(4'-aminophenylamino)-anthraquinone;
1-hydroxy-4-(3'-aminophenylamino)-anthraquinone;
1-amino-2-chloro-4-hydroxyanthraquinone; or
1,5-diamino-4,8-dihydroxyanthraquinone.

16. A method according to claim 1 in which the transfer printing is effected under vacuum conditions.

* * * * *